US008942070B1

(12) United States Patent
Shah

(10) Patent No.: US 8,942,070 B1
(45) Date of Patent: Jan. 27, 2015

(54) MATHEMATICAL WATCHES

(71) Applicant: Bhavesh Shah, Bloomingdale, IL (US)

(72) Inventor: Bhavesh Shah, Bloomingdale, IL (US)

( * ) Notice: Subject to any disclaimer, the term of this patent is extended or adjusted under 35 U.S.C. 154(b) by 56 days.

(21) Appl. No.: 13/849,478

(22) Filed: Mar. 23, 2013

(51) Int. Cl.

| | |
|---|---|
| ***G04C 19/00*** | (2006.01) |
| ***G04B 19/00*** | (2006.01) |
| ***G04B 25/00*** | (2006.01) |
| ***G04C 17/00*** | (2006.01) |
| ***G04G 9/00*** | (2006.01) |

(52) U.S. Cl.
CPC ..... *G04G 9/0064* (2013.01)
USPC ..... 368/224; 368/82; 368/223; 368/239

(58) Field of Classification Search
CPC ..... G04G 9/00; G04G 9/0064; G04G 9/02
USPC ..... 368/82, 223, 224, 239
See application file for complete search history.

(56) References Cited

U.S. PATENT DOCUMENTS

| | | | | |
|---|---|---|---|---|
| 4,163,230 | A * | 7/1979 | Konii | 368/84 |
| 4,568,086 | A * | 2/1986 | Krogh | 273/141 R |
| 5,674,075 | A * | 10/1997 | Sherman | 434/188 |
| D419,600 | S * | 1/2000 | Marasca | D19/64 |
| 7,710,834 | B1 * | 5/2010 | Schrock et al. | 368/110 |
| 8,379,489 | B1 * | 2/2013 | Jones | 368/223 |
| 2004/0190380 | A1 * | 9/2004 | Wojcieszak | 368/69 |
| 2007/0056117 | A1 * | 3/2007 | Gardiner et al. | 368/223 |
| 2007/0258336 | A1 * | 11/2007 | Bailey | 368/223 |

OTHER PUBLICATIONS

"Pop Quiz Wall Clock", Dec. 1, 2009, p. 1.*

* cited by examiner

*Primary Examiner* — Amy Cohen Johnson
*Assistant Examiner* — Daniel Wicklund
(74) *Attorney, Agent, or Firm* — Depeng Bi; The Law Offices of Konrad Sherinian, LLC

(57) ABSTRACT

A mathematical watch displays time using mathematical problems. The answers to the mathematical problems indicate the current time. The mathematical problems are periodically updated on a screen of the mathematical watch. The mathematical watch also displays an angle shape that indicates the current temperature.

20 Claims, 8 Drawing Sheets

600

| 602 | 604 | 606 | 608 |
|---|---|---|---|
| 1 | 5 | 1 | $\mathrm{Log}_{10}{}^{a} = 0$ |
| 2 | 5 | 2 | $\mathrm{Log}_{10}{}^{100} = a$ |
| 3 | 3 | 3 | $a^3 = 27$ |
| 4 | 2 | 4 | $a * 29 = 116$ |
| 5 | 4 | 5 | $a! = 120$ |
| 6 | 3 | 6 | $a^2 = 36$ |
| 7 | 3 | 7 | $a * 9 = 63$ |
| 8 | 3 | 8 | $a = 2^3$ |
| 9 | 2 | 9 | $a = 81 \div 9$ |
| 10 | 5 | 10 | $\mathrm{Log}_{10}{}^{a} = 2$ |
| 11 | 3 | 11 | $a^2 = 121$ |
| 12 | 3 | 12 | $a^2 = 144$ |
| ⋮ | | | |
| 13 | 2 | 1 | $a * 100 = 100$ |
| 14 | 1 | 2 | $a + 3 = 5$ |

610 612 614 616 618

FIG. 6

700

| 702 | 704 | 706 | 708 |
|---|---|---|---|
| 1 | 2 | 0 | $a * 100 = 0$ |
| 2 | 1 | 1 | $a + 19 = 20$ |
| 3 | 2 | 2 | $a = 102 \div 51$ |
| 4 | 3 | 3 | $a^3 = 27$ |
| 5 | 4 | 4 | $a! = 24$ |

710 712 714

⋮

| | | | |
|---|---|---|---|
| 501 | 3 | 59 | $a = 177 \div 3$ |
| 502 | 1 | 0 | $a = 100 - 100$ |
| 503 | 1 | 1 | $a = 5 - 5 + 1$ |

716

FIG. 7

MATHEMATICAL WATCHES

FIELD OF THE DISCLOSURE

The present invention relates to watches, and more particularly relates to a watch that presents time using answers to mathematical problems.

DESCRIPTION OF BACKGROUND

A watch is a device that provides time information. Usually, time is specified as a combination of date, hour, minute and/or second. Traditional mechanical watches, such as wall clocks or wristwatches, generally provide time in the form of hour, minute and second. Some mechanical watches also provide date of the month information. Digital watches usually provide more time information, such as year and month.

In recent years, computerized watches, often referred to as smartwatches, have been developed and become widely used. A smartwatch provides features that are beyond timekeeping and comparable to a personal digital assistant ("PDA"). For example, a smartwatch is capable of performing tasks like calculations and translations. Some smartwatches are capable of running mobile software application. For example, WIMM One smartwatches from WIMM Labs run a modified version of the ANDROID operating system. Mobile software applications can be downloaded into the WIMM One smartwatches over a link, such as a radio based connection (Wi-Fi or BLUETOOTH) or Universal Serial Bus ("USB") connection. Each WIMM One smartwatch has a screen for displaying information, such as time, text and video.

As smartwatches become widely accepted, more benefits can be derived from them. For example, smartwatches can be used to improve young people's mathematical skills. As an additional example, smartwatches can be used by seniors to maintain their mental sharpness through solving mathematical problems.

Accordingly, there is a need for a mathematical watch that presents time using mathematical problems or equations.

OBJECTS OF THE DISCLOSED SYSTEM, METHOD, AND APPARATUS

Accordingly, it is an object of this disclosure to provide a watch that presents time that is indicated by answers to one or more problems.

Another object of this disclosure is to provide a watch that presents time that is indicated by answers to one or more mathematical problems.

Another object of this disclosure is to provide a watch that periodically updates mathematical problems displayed on a screen of the watch.

Another object of this disclosure is to provide a watch that presents partial time information that is indicated by answers to one or more mathematical problems.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

Generally speaking, pursuant to the various embodiments, the present disclosure provides a mathematical watch and method for presenting time using mathematical problems. Answers to the mathematical problems displayed on the mathematical watch indicate the present time. The mathematical watch includes a housing in which a processor and a screen are disposed. The screen is coupled to the processor. A computer software program is adapted to operate on the processor. The software program is further adapted to retrieve a time wherein the time includes an hour and a minute, and periodically select a first mathematical problem from a first set of mathematical problems in a database, wherein an answer to the first mathematical problem has a same value as the hour. The software program is further adapted to display the first mathematical problem on the screen. Moreover, the software program is adapted to periodically select a second mathematical problem from a second set of mathematical problems in the database, wherein an answer to the second mathematical problem has a same value as the minute. The software program is further adapted to display the second mathematical problem on the screen.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 6 is a block diagram depicting a database of mathematical problems for deriving hour of current time in accordance with the teachings of this disclosure; and FIG. 7 is a block diagram depicting a database of mathematical problems for deriving minute of current time in accordance with the teachings of this disclosure.

DETAILED DESCRIPTION

Figure 1:
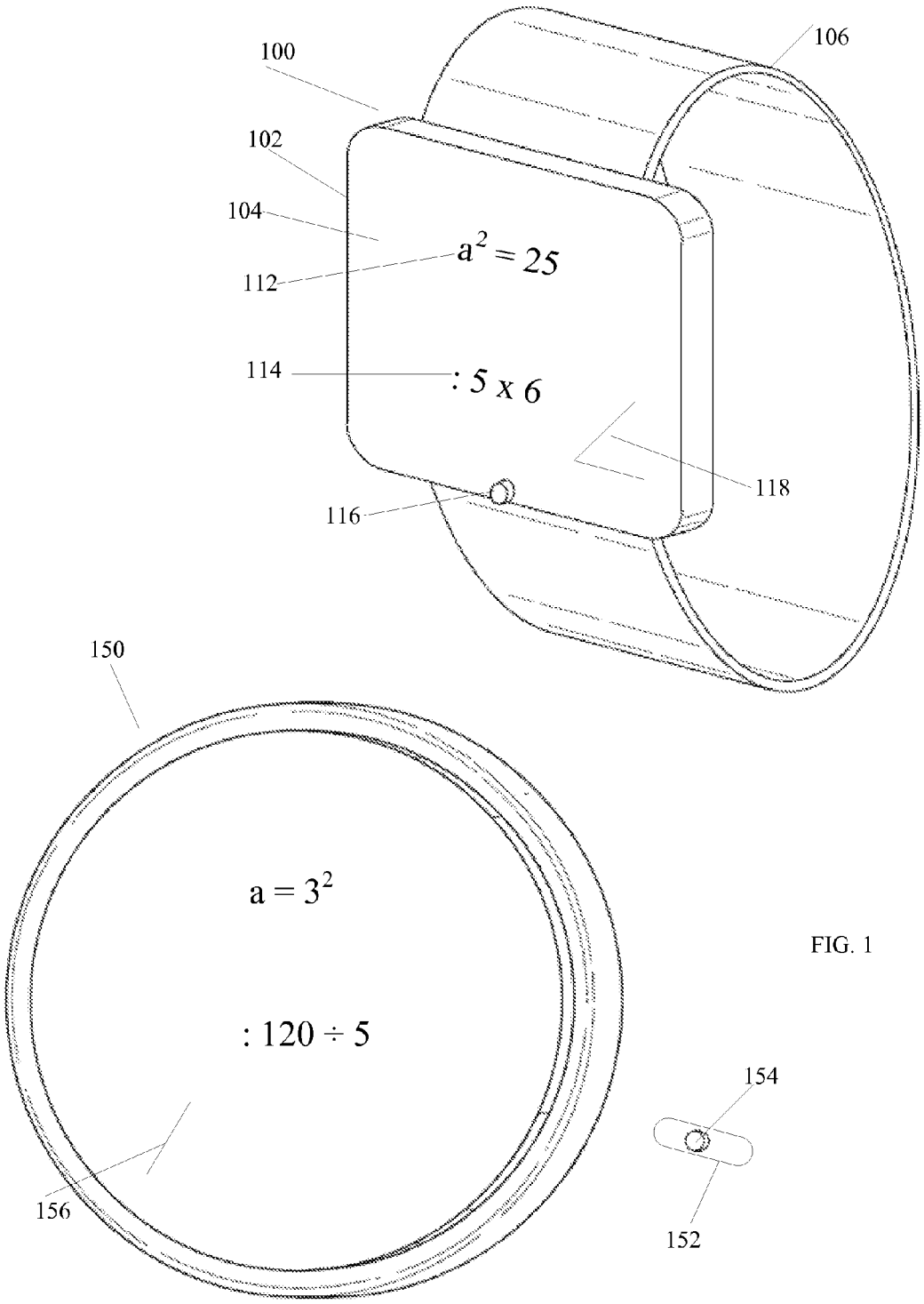
FIG. 1 is a perspective view of two mathematical watches in accordance with the teachings of this disclosure.
Figure 1A:
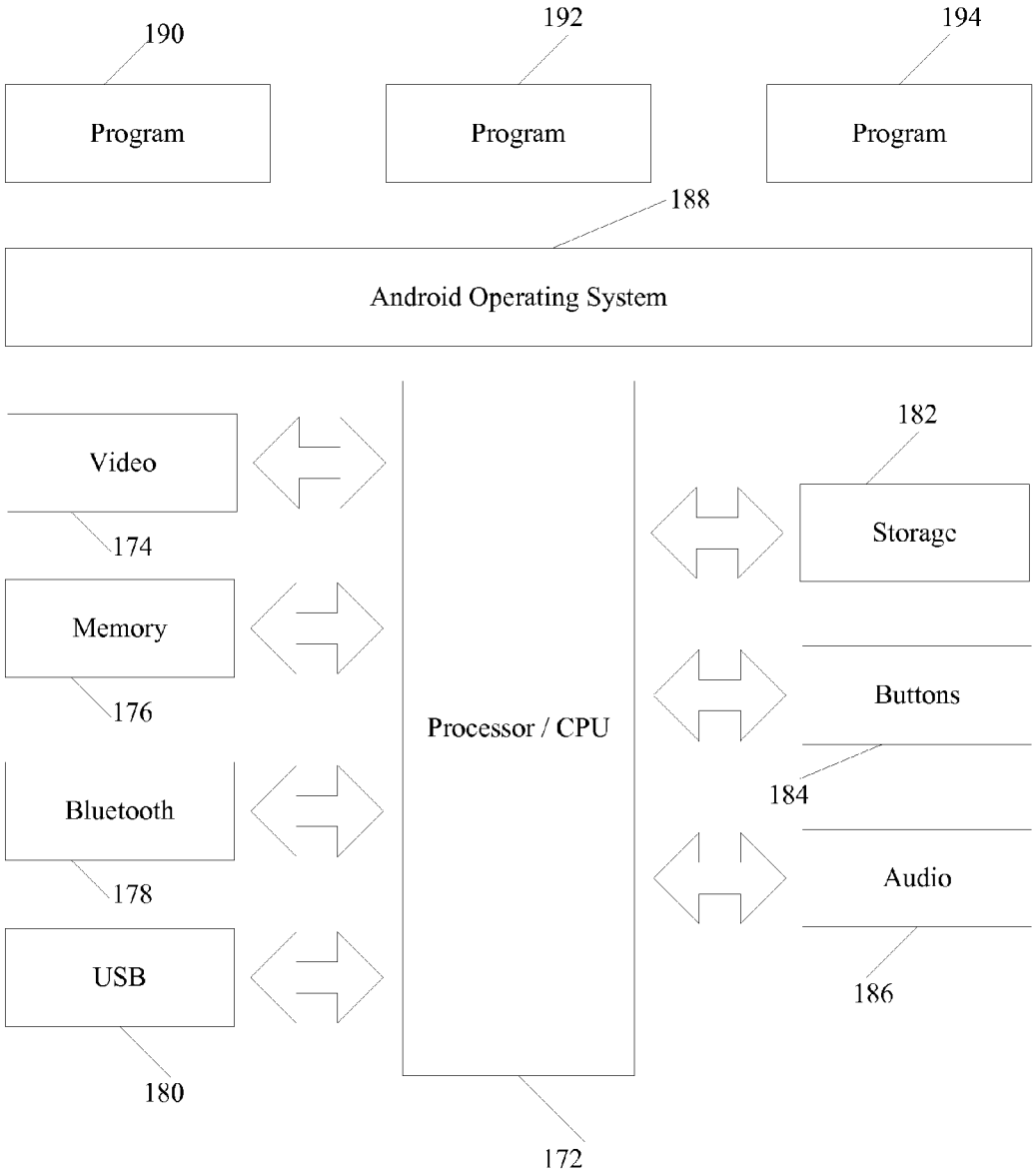
FIG. 1A a block diagram depicting an architecture of a mathematical watch in accordance with the teachings of this disclosure.

Turning to the Figures and to FIG. 1 in particular, a perspective view of two mathematical watches 100 and 150 is shown. In one embodiment, the watch 100 is a wristwatch, such as a smartwatch, and the watch 150 is a digital wall clock. The wristwatch 100 includes a watch housing 102 and a wristband 106 that attaches the watch 100 to a user's wrist. In one implementation, the watch housing 102 includes a various electronic components (such as a screen 104) and software components. A block diagram of the watch housing 102 is further illustrated by reference to FIG. 1A. Turning now to FIG. 1A, a central processing unit ("CPU") or central processing core 172 interfaces and/or controls various components, such as a video interface 174, a memory 176, a BLUETOOTH interface 178, a USB interface 180, a storage 182, various buttons 184 and an audio interface 186. The video interface 174 includes the screen 104. An operating system 188, such as ANDROID, runs on the CPU 172 and provides a running environment for various computer software programs, such as programs 190,192,194.

Turning back for FIG. 1, both watches 100 and 150 are capable of displaying or presenting time in conventional formats (such as 8:23, 3:45 PM or 14:24) and mathematical formats. For example, a mathematical problem or equation 112 is displayed for a user of the watch 100 to solve and thus derive the current hour. The answer or solution to the problem 112 is 5, i.e., the value of the variable a is 5. Similarly, the problem 114 is displayed for the user to solve and thus derive the current minute. The result to the problem 114 is 30. Accordingly, the current time is 5:30. 5:30 may indicate 5:30 AM or 5:30 PM. As used herein, the problem 112 is also referred to as an hour problem while the problem 114 is also referred to as a minute problem. In a different implementation, only one problem, an hour problem or minute problem is shown and used to arrive at the current time. In a further implementation, year, month and/or date can also be derived from mathematical problems. In a still further implementation, temperature indicators 118 and 156 are shown as angles on the watches 100 and 150 respectively.

Figure 2:
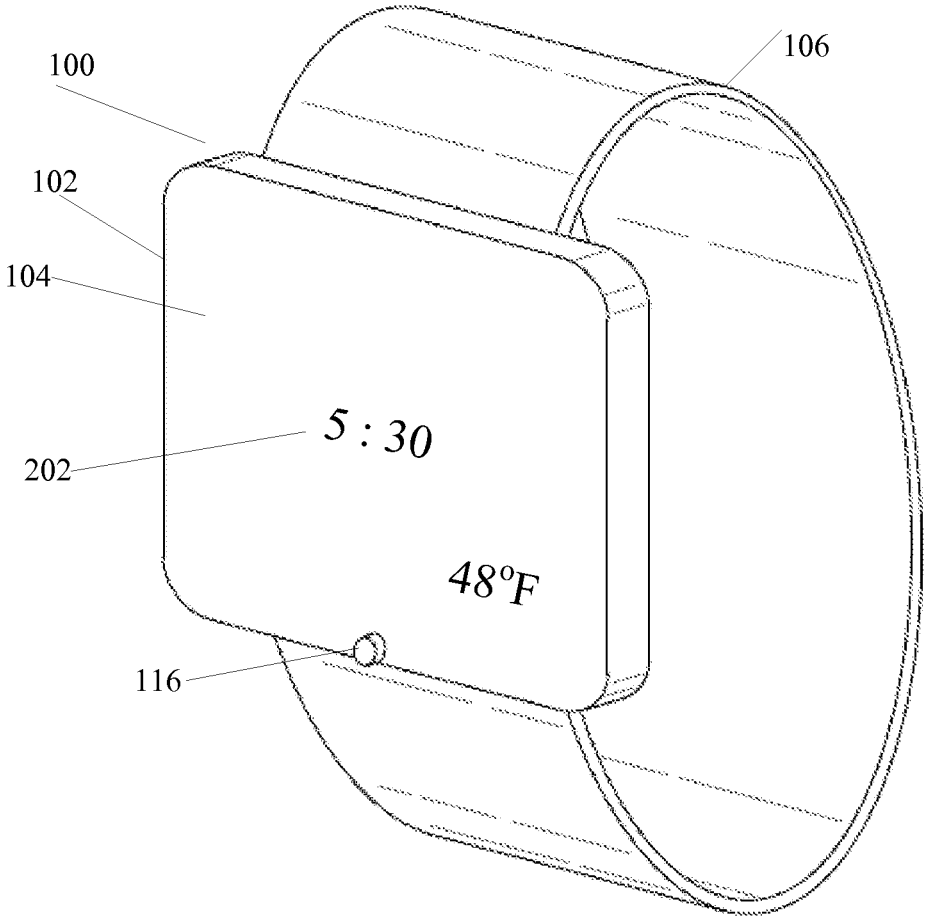
FIG. 2 a perspective view of a mathematical watch in accordance with the teachings of this disclosure.

The watch 100 further includes a button 116, pressing of which causes the current time displayed on the screen 104 in a conventional format. In other words, the button 116 is an answer button that allows the user of the watch 100 to display the answers to the problems 112 and 114. For example, when the current is 5:30 PM and the user presses the button 116, the screen 104 displays the time 5:30 in a conventional format as shown in FIG. 2. 30 is a product of 5 and 6, i.e., 30=5×6 or 30=5*6. As to the watch 150, an answer button 154 is provided on a remote control 152. The remote control 152 communicates pressing events and releasing events of the answer button 154 over a wireless link, such as a BLUETOOTH connection to the watch 150. Where the temperature indicator 118 or 156 is available, the answer button 116 or 154 also causes the current temperature displayed in, for example, Fahrenheit (° F.) or Celsius (° C.).

Figure 3:
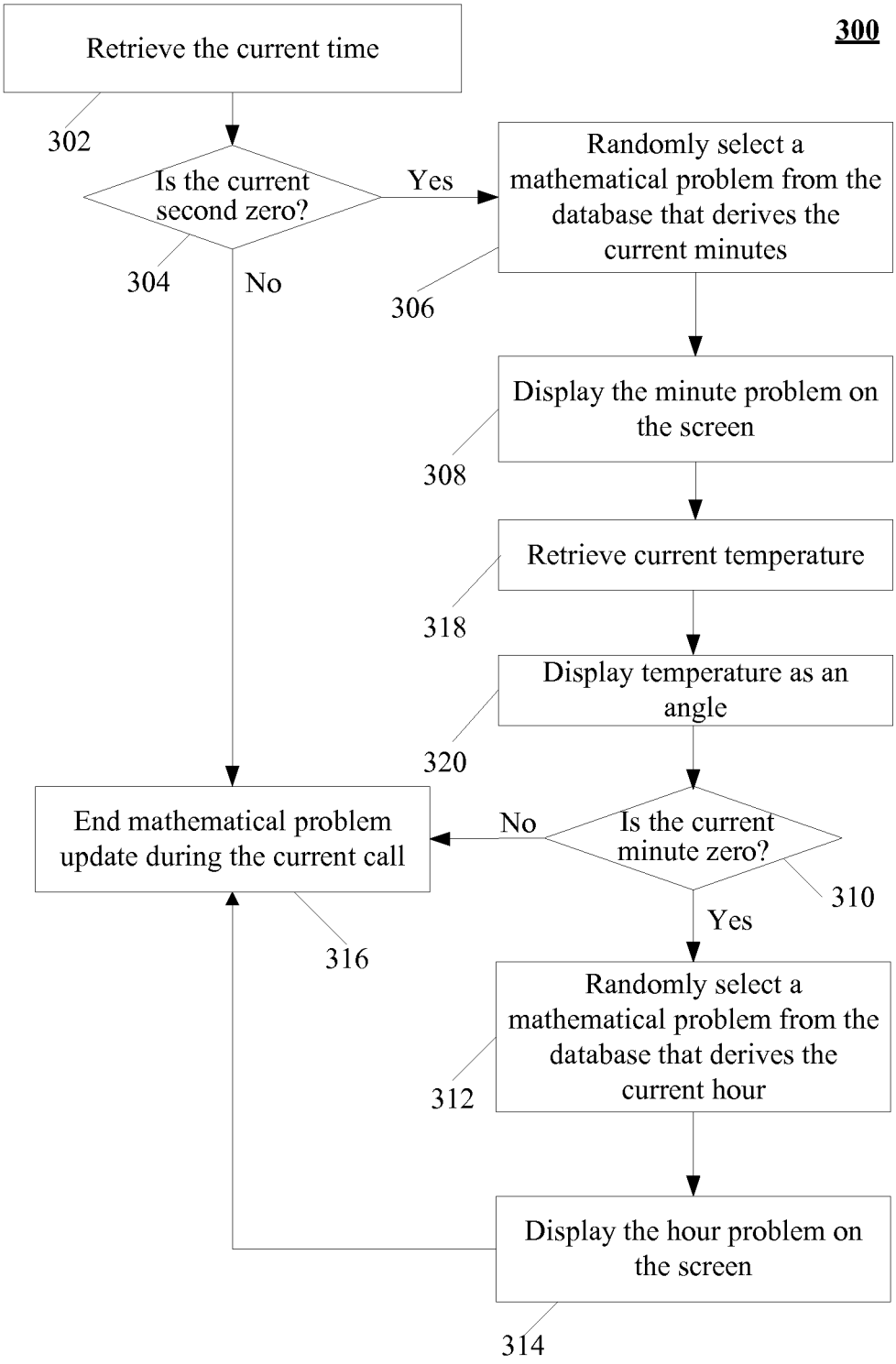
FIG. 3 is a flow chart depicting a process by which a mathematical watch presents time using mathematical problems in accordance with the teachings of this disclosure.

Referring to FIG. 3, a process 400 for displaying mathematical problems on the watch 100 is shown. In one implementation, the process 400 is implemented by a computer software program using a computer programming language, such as Java. The software program is configured to be executed once each second, minute or hour. For example, this software program is configured as a callback function that is called by the underlying operating system wherein the calling is triggered by a timer of the underlying system. At 302, the software program retrieves, for example, by calling an Application Program Interface ("API") function, the current time. The current time is usually represented by a structure that includes numbers indicating the current year, month, date, hour, minute and second. At 304, the software program checks whether the second part of the current time, i.e., the current second, is zero or not. If so, at 306, the software program randomly selects a mathematical problem from a database of mathematical problems. The selected mathematical problem is used to derive the current minute. In other words, the answer to the selected mathematical problem is the current minute.

Under this illustrative implementation, the minute problem is updated every sixty (60) seconds. Alternatively, the minute problem can be updated in less than sixty seconds. For example, to update the minute problem every thirty (30) seconds, 306 is executed whenever the current second is zero or thirty. Moreover, under this illustrative implementation, the minute problem is randomly selected. Alternatively, available minute problems can be used in a rotational manner. In a further implementation, the selection of the minute problem can factor in the difficulty level and/or type (such as linear equation or exponential function) of the available minute problems. The difficulty level and/or type can be configured using a user interface of the software program.

The selection of the minute problem is further illustrated by reference to FIG. 7 showing a table 700 of minute problems. The table 700 exists in a database that is stored in a storage, such as the storage 182. The database can be updated over the interfaces 178 or 180. At run time, the table 700 can be loaded into memory, such as the memory 176. Alternatively, the table 700 resides in the memory 176. The table 700 includes a record ID field 702, problem difficulty level field 704, a minute problem answer field 706 and a minute problem field 708. Each minute problem is represented in a row or record, such as records 710,712,714,716. An answer field contains the answer to the corresponding mathematical problem of the same record. When a minute problem is to be selected, the input is the current minute. The current minute is matched to the answer field 706.

Only records with matching answers are considered and designated as candidate problems. A minute problem can be randomly selected from the candidate problems. For example, where there are two hundred candidate problems for the current minute, a random number in the range of one and two hundred is generated by the software program. The candidate problem that matches the random number is then selected. For instance, where the random number is nine, then the ninth candidate problem is selected. Alternatively, a different selection algorithm (such as round-robin) can be used to select a mathematical problem. In a further implementation, the selection can be based on the difficulty level and/or type which is passed to the selection algorithm as an additional input.

Turning back to FIG. 3, at 308, the software program displays the selected minute problem to replace the currently displayed minute problem on the screen 104. At 318, the software program retrieves the current temperature, which can be provided by a temperature measuring device of the watch 100 or 150. At 320, the software program displays the temperature with a shape of an angle. At 310, the software program checks whether the current minute is zero or a different predetermined number between zero and eleven. If so, at 312, the software program randomly selects an hour problem from a database that is used to derive the current hour. In other words, the answer to the selected mathematical problem is identical to the current hour. The selection of the hour problem is further illustrated by reference to FIG. 6, where a table 600 of available hour problems is shown. The table 600 resides in a database (that is same as or different from the database of FIG. 7) that is stored in a storage, such as the storage 182. The database can be updated over the interfaces 178 or 180. At run time, the table 600 can be loaded into memory, such as the memory 176. Alternatively, the table 600 resides in the memory 176.

The table 600 includes a record ID field 602, problem difficulty level field 604, a minute problem answer field 606 and a minute problem field 608. Each minute problem is represented in a row or record, such as records 610,612,614,616,618. An answer field contains the answer to the corresponding mathematical problem of the same record. When a minute problem is to be selected, the input is the current minute. The current minute is matched to the answer field 606. Only records with matching answers are considered and designated as candidate problems. A minute problem can be randomly selected from the candidate problems. For example, where there are fifty candidate problems for the current minute, a random number in the range of one and fifty is generated by the software program. The candidate problem that matches the random number is then selected. For instance, where the random number is eleven, then the eleventh candidate problem is selected. Alternatively, a different selection algorithm (such as round-robin) can be used to select a mathematical problem. In a further implementation, the selection can be based on the difficulty level and/or type which is passed to the selection algorithm as an additional input.

Turning back to FIG. 3, at 314, the software program displays the selected hour problem to replace the currently displayed hour problem on the screen 104. At 316, the software program ends the mathematical problem update during the current call of the process 300. Turning back to 310, where the current minute is not zero, at 316, the software program ends the mathematical problem update during the current call of the process 300. Turning back to 304, where the current second is not zero, at 316, the software program ends the mathematical problem update during the current call of the process 300.

Figure 4:
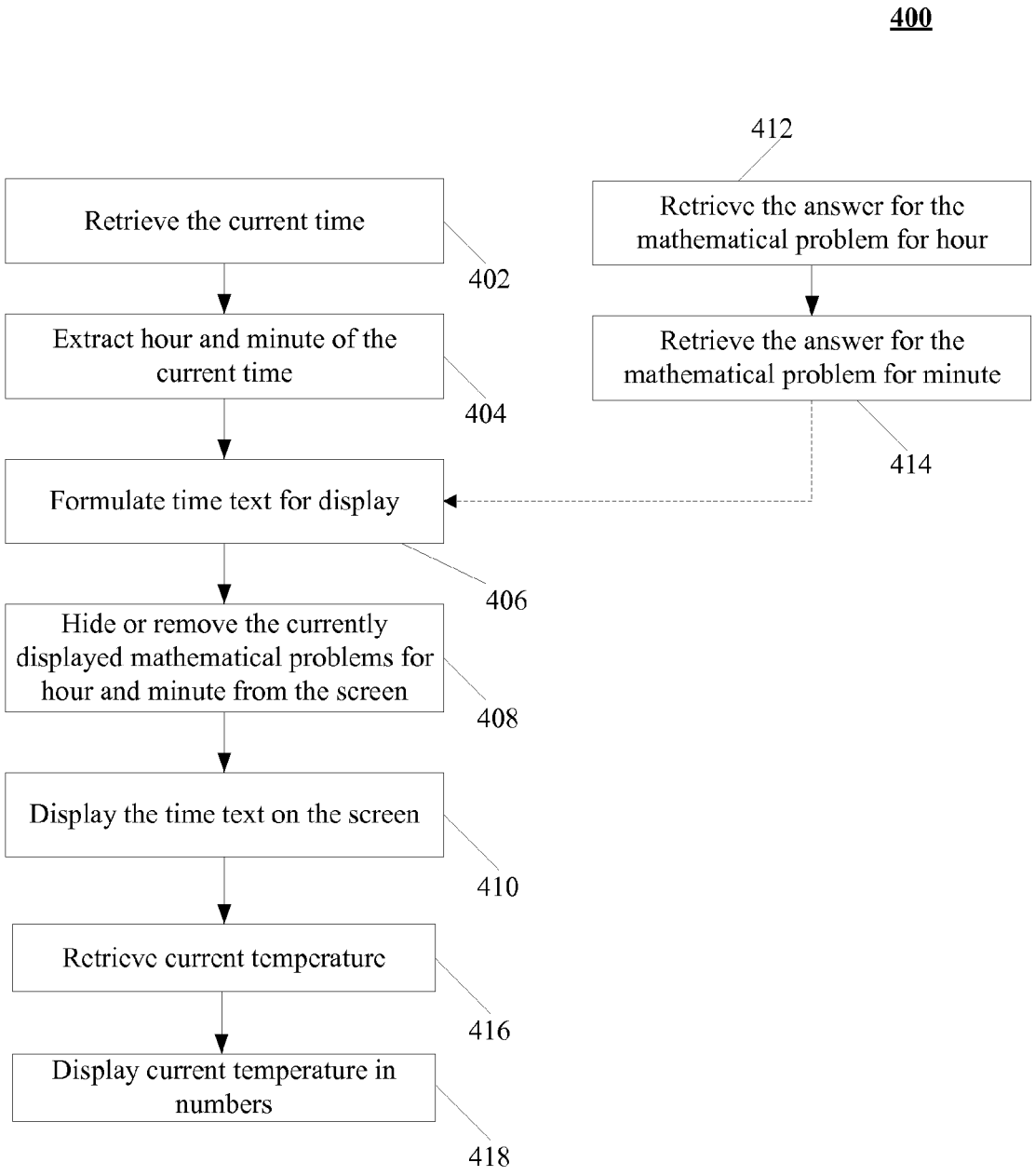
FIG. 4 is a flow chart depicting a process by which a mathematical watch displays time in a conventional format in accordance with the teachings of this disclosure.

Sometimes, the user of the watch 100 or 152 may want to see the current time without having to solve the mathematical problems first. To do so, the user can simply press the button 116. When the button 116 is pressed, a process 400 (as shown in FIG. 4) for displaying the current time in a conventional format, such as 5:30, is performed. In one implementation, the process 400 is performed by a software program. The software program can be configured to be called when the button 116 is pressed. For example, the software program can be registered with the underlying operating system as an event handler for button press of the button 116. At 402, the software program retrieves the current time, for example, by calling an API. At 404, the software program extracts the current hour and minute from the retrieved time, which can be represented by a data structure. At 406, the software program formulates time text for display. For example, where the hour is 6 and minute is 54, the formulated time text will be 6:54.

At 408, the software program hides or removes the currently displayed mathematical problems for hour and time from the screen 104. For example, the rectangular area showing a mathematical problem can be cleared or invalidated by calling a screen drawing API. At 410, the software program displays the time text on the screen 104, such as that shown in FIG. 2. At 416, the software program retrieves current temperature from, such as, a temperature measuring device of the mathematical watch 100 or 150. At 418, the software program displays the temperature in numbers, such as 28° C. or 94° F. Alternatively, the software program uses answers to the currently displayed problems to formulate the time text for display. At 412, the software program retrieves the answer for the currently displayed hour mathematical problem. For example, in one implementation, the answer is readily available in the memory 176. At 414, the software program retrieves the answer for the currently displayed minute mathematical problem. At 406, the software program formulates time text for display.

While the button 116 is being pressed, the current time is displayed in the conventional format. Accordingly, when the button 116 is being pressed, the process 300 is not executed or performed. Alternatively, at the beginning, the process 300 includes an element which checks whether the button 116 is currently being pressed. If so, the process 300 ends and does not display mathematical problems. Otherwise, the process 300 continues to perform its functionality.

Figure 5:
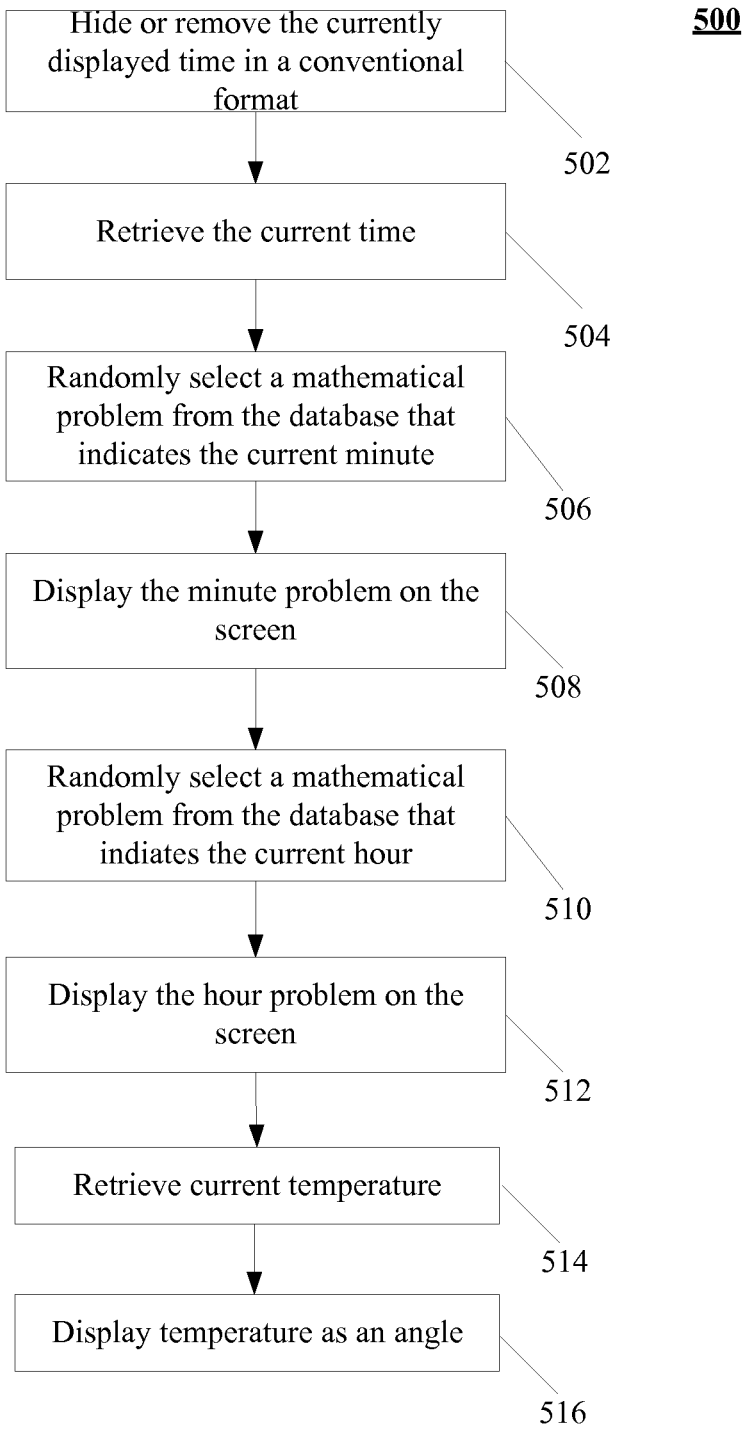
FIG. 5 is a flow chart depicting a process by which a mathematical watch presents time using mathematical problems in accordance with the teachings of this disclosure.

When the button 116 is released, a process 500 (as shown in FIG. 5) for restoring the screen 104 with mathematical problems is performed. Referring now to FIG. 5, at 502, a software program, implementing and performing the process 500, hides or removes the currently displayed time in a conventional format. At 504, the software program retrieves the current time, for example, by calling an API. At 506, the software program randomly selects a mathematical problem, from the table or database 700, that indicates the current minute. At 508, the software program displays the minute problem on the screen 104. At 510, the software program randomly selects a mathematical problem, from the table or database 600, that indicates the current hour. At 512, the software program displays the hour problem on the screen 104. Alternatively, different algorithms (such as round-robin) can be used to select the mathematical problems. Furthermore, the difficulty level and/or type of problems can be considered in selecting the mathematical problems. At 514, the software program retrieves current temperature from, such as, a temperature measuring device of the mathematical watch 100 or 150. At 516, the software program displays the temperature as an angle.

Obviously, many additional modifications and variations of the present disclosure are possible in light of the above teachings. Thus, it is to be understood that, within the scope of the appended claims, the disclosure may be practiced otherwise than is specifically described above. For example, the operating system 188 can be a different operating system, such as Palm OS. As an additional example, a separate user interface can be implemented to allow users to configure the refresh rate of mathematical problems. As a still further example, each of the tables 600 and 700 has a type column; and the user interface allows users to specify types of mathematical problems to display on their mathematical watches.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below.

What is claimed is:

1. A mathematical watch for providing time using mathematical problems, the mathematical watch comprising:

i) a housing;

ii) a processor disposed in the housing;

iii) a screen disposed in the housing and coupled to the processor;

iv) software adapted to operate on the processor, the software adapted to retrieve a time wherein the time includes an hour and a minute;

v) the software further adapted to periodically select a first mathematical problem from a first set of mathematical problems in a database, wherein an answer to the first mathematical problem has a same value as the hour;

vi) the software further adapted to display the first mathematical problem on the screen;

vii) the software further adapted to periodically select a second mathematical problem from a second set of mathematical problems in the database, wherein an answer to the second mathematical problem has a same value as the minute; and viii) the software further adapted to display the second mathematical problem on the screen.

2. The mathematical watch of claim 1 wherein the first mathematical problem is randomly selected from the first set of mathematical problems.

3. The mathematical watch of claim 1 wherein each mathematical problem in the first set of mathematical problems has a same difficulty level or a same type.

4. The mathematical watch of claim 1 wherein the first mathematical problem is selected every one hour.

5. The mathematical watch of claim 1 wherein the second mathematical problem is randomly selected from the second set of mathematical problems.

6. The mathematical watch of claim 1 wherein each mathematical problem in the second set of mathematical problems has a same difficulty level or a same type.

7. The mathematical watch of claim 1 wherein the second mathematical problem is selected every one minute.

8. The mathematical watch of claim 1 wherein the software is further adapted to display an angle shape on the screen that indicates a temperature.

9. The mathematical watch of claim 1 further comprising an answer button wherein:

i) where the answer button is pressed, the software is further adapted to display the hour and the minute using one or more numbers on the screen; and ii) where the answer button is released, the software displays the first and second mathematical problems.

10. The mathematical watch of claim 9 wherein:

i) where the answer button is pressed, the software is further adapted to display a temperature using one or more numbers on the screen; and ii) where the answer button is released, the software displays an angle shape on the screen that indicates the temperature.

11. A method for providing time using mathematical problems, the method operating on a processor within a mathematical watch and comprising:

i) retrieving a time from the mathematical watch wherein the time includes an hour and a minute;

ii) periodically selecting a first mathematical problem from a first set of mathematical problems in a database, wherein an answer to the first mathematical problem has a same value as the hour;

iii) displaying the first mathematical problem on a screen of the mathematical watch;

iv) periodically selecting a second mathematical problem from a second set of mathematical problems in the database, wherein an answer to the second mathematical problem has a same value as the minute; and v) displaying the second mathematical problem on the screen of the mathematical watch.

12. The method of claim 11 wherein the first mathematical problem is randomly selected from the first set of mathematical problems.

13. The method of claim 11 wherein each mathematical problem in the first set of mathematical problems has a same difficulty level or a same type.

14. The method of claim 11 wherein the first mathematical problem is selected every one hour.

15. The method of claim 11 wherein the second mathematical problem is randomly selected from the second set of mathematical problems.

16. The method of claim 11 wherein each mathematical problem in the second set of mathematical problems has a same difficulty level or a same type.

17. The method of claim 11 wherein the second mathematical problem is selected every one minute.

18. The method of claim 11 further comprising displaying an angle shape that indicates a temperature.

19. The method of claim 11 further comprising:

i) where a request for answer is received, displaying the hour and the minute using one or more numbers on the screen; and ii) where a request for answer is released, displaying the first and second mathematical problems.

20. The method of claim 19 further comprising:

i) where a request for answer is received, displaying a temperature using one or more numbers on the screen; and ii) where a request for answer is released, displaying an angle shape on the screen that indicates the temperature.

* * * * *